US005191716A

United States Patent [19]

Anderson

[11] Patent Number: 5,191,716

[45] Date of Patent: Mar. 9, 1993

[54] TOOL FOR MEASURING, MARKING AND CUTTING FABRIC MATERIALS

[76] Inventor: James E. Anderson, 832 S. Ashland, LaGrange, Ill. 60525

[21] Appl. No.: 905,322

[22] Filed: Jun. 29, 1992

[51] Int. Cl.[5] ..... B43L 13/00

[52] U.S. Cl. ..... 33/483; 33/494; 33/474

[58] Field of Search ..... 7/164, 167; 16/114 R, 16/110 R; 33/483, 1 B, 1 N, 11, 12, 17, 2 R, 494, 476, 474, 477

[56] References Cited

U.S. PATENT DOCUMENTS

| | | | |
|---|---|---|---|
| 830,683 | 9/1906 | Spangler | 15/235.4 |
| 2,239,798 | 4/1941 | Tinnerman | 16/114 R |
| 2,364,529 | 12/1944 | Hill | 33/474 |
| 3,484,894 | 12/1969 | Fletcher | 16/114 R |
| 4,551,923 | 11/1985 | Sung | 33/476 |
| 4,779,346 | 10/1988 | Schafer | 33/11 X |
| 5,016,357 | 5/1991 | Leonard | 33/1 K X |

FOREIGN PATENT DOCUMENTS

| | | | |
|---|---|---|---|
| 520561 | 2/1921 | France | 33/1 B |
| 195987 | 2/1938 | Switzerland | 33/474 |
| 623461 | 5/1949 | United Kingdom | 16/114 R |

*Primary Examiner*—Harry N. Haroian
*Attorney, Agent, or Firm*—Robert J. Black

[57] ABSTRACT

A tool for holding fabric during cutting, measuring, etc., consisting of a handle and a number of sheets, each of a different size and of transparent material, each including the handle selectively connectable to each of the transparent sheets, each sheet having indicia marked on the transparent sheets to assist in cutting, measuring, etc.

11 Claims, 1 Drawing Sheet

TOOL FOR MEASURING, MARKING AND CUTTING FABRIC MATERIALS

BACKGROUND OF THE INVENTION

1. Field of the Invention

The present invention relates to holding devices and more particularly to a tool facilitating the measuring, marking, cutting or trimming of fabric and related materials.

2. Background Art

Many devices are known for measuring and marking on fabrics and similar material as utilized by a seamstress or tailor. Usual tools applied for these purposes are rulers or yardsticks or tapemeasures, all of which when employed frequently readily permit shifting of the fabric or material during measuring, marking or cutting operations. While certain devices have been created to assist in the measuring and marking operations, such as that disclosed in U.S. Pat. No. 4,779,346, the problem of shifting of the fabric or material particularly during cutting operations still is present.

Quilt makers also experience similar difficulties during the laying out of patterns, cutting of fabric and so on and it is important to prevent shifting during the cutting of the pattern.

To the best of applicant's knowledge, no satisfactory device for securely holding the fabric or similar material during such operations is known.

SUMMARY OF THE INVENTION

The present invention consists of a set of flat, rectangular sheets of clear plastic or similar material adapted for attachment to a handle which provide means for securely holding fabric or similar material during operations such as marking, cutting, trimming, etc.

Each piece of transparent material is rectangular in form and includes a first set of one or more mutually parallel lines and a second set of one or more mutually parallel lines positioned at substantially right angles to the first as to form a grid pattern. It is also possible that additional lines may be added to include angle lines oriented at such angles as 30 degrees, 45 degrees, and 60 degrees with respect to the first or second set of above referred to parallel lines. The lines referred to above may be numbered based on any standard numbering or measuring scheme while it is possible to have for the angularly placed lines, an indication of their degree of angle.

Each of the transparent sheets includes thereon connecting devices which permit the associated handle to be readily affixed to and connected to any of the available transparent flat sheets. These sheets are typically manufactured of a clear plastic, such as polycarbonate or acrylic material. The material essentially being transparent in characteristic with the lines and indicia superimposed thereon printed or painted in some contrasting color so as to be readily apparent when used upon fabric or related materials.

In the preferred embodiment of the present invention a plurality of different rectangular forms of clear plastic sheets are employed, one being relatively narrow and long, another being essentially rectangular and of medium size, and then a very large rectangular sheet, each of which may be employed with the associated handle to work on particular forms of material. For example, the smallest part may have dimensions of approximately 1½"×24", the second having a dimension of approximately 6½"×24", and the largest being dimensionally approximately 15" square. Each of the plastic sheets includes at least two studs mounted thereon and projecting from the upper surface, adapted to engage receiving mechanisms in the bottom of each end of the associated handle. Thus by simple manual operation the handles may be affixed or removed from one or the other of the flat sheets, as required.

DESCRIPTION OF THE PREFERRED EMBODIMENT

Figure 1:
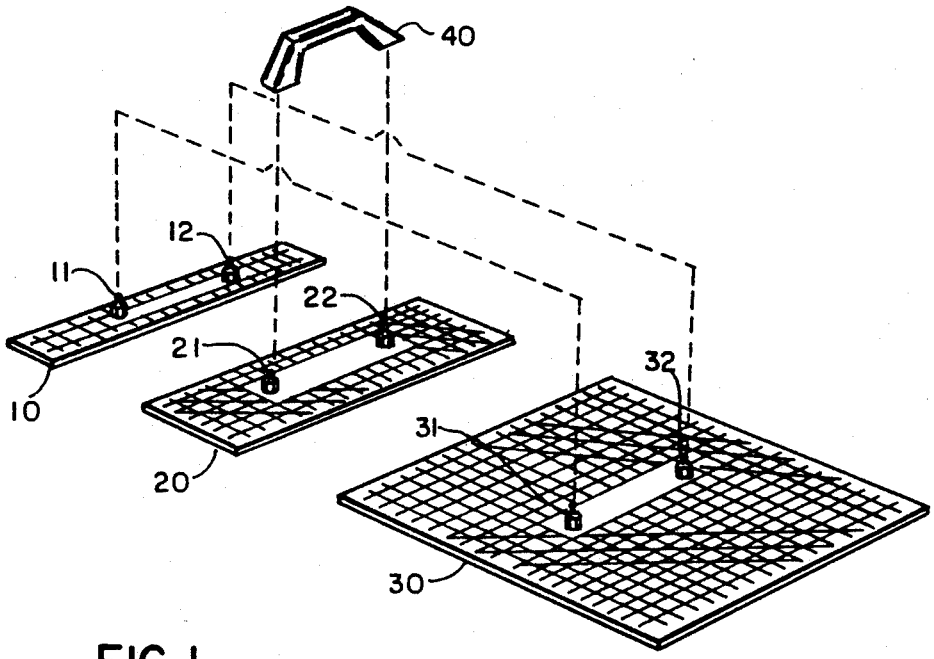
FIG. 1 is a perspective view of a complete tool set consisting of three plastic sheets of different sizes and an associated handle.

Referring now to FIG. 1, three transparent sheets of plastic or similar material numbered 10, 20 and 30 are shown. It will be obvious from FIG. 1 that each of these sheets is of a different configuration and size, each being readily adapted to hold down fabrics of a different size. The handle 40 is removable and is adapted to be positioned on any one of the transparent sheets as shown. As may be seen in FIG. 2, parallel spaced lines at right angles forming a grid pattern are embossed or printed on each sheet along with measurement indicia appropriate to the spacing of the lines of the grid pattern. Also included are diagonal lines shown on each transparent sheet with indicia included therein to indicate the angle of degree at which such diagonal lines are placed.

As may be seen in FIGS. 1, 2, 3 and 4, handle 40 may be positioned on any of the sheets with particular detail shown regarding sheet number 20. Handle 40 includes therein female type receptacle items similar to "Tinnerman" nuts and other related fasteners as shown as 23 in FIG. 4 wherein studs such as 11 and 12 of transparent sheet 10, 21 and 22 of sheet 20, and 31 and 32 of sheet 30 may readily be engaged.

Figure 2:
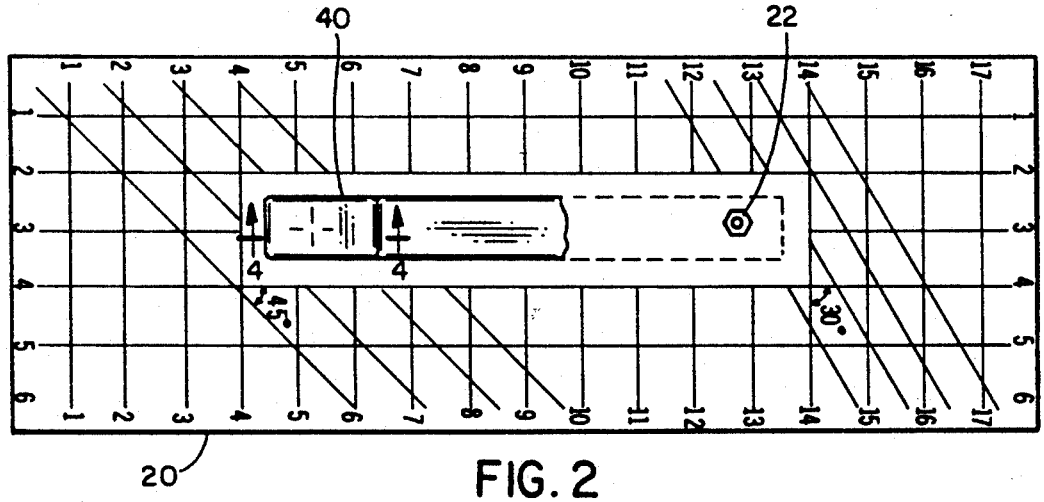
FIG. 2 is a top view of a plastic sheet showing mounted thereon a handle for use with the sheet as a holding device.
Figure 3:
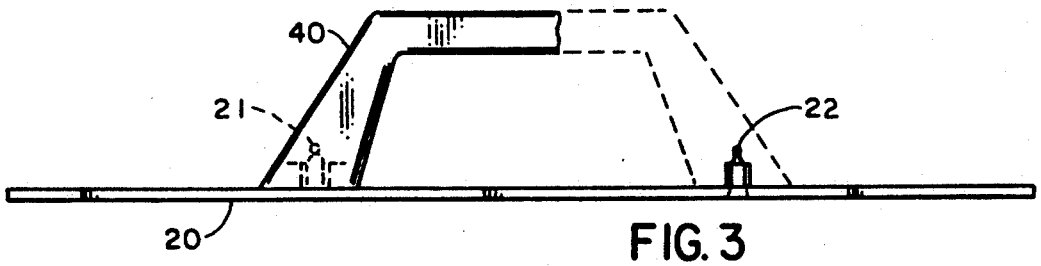
FIG. 3 is a side view of the tool including the plastic sheet and associated handle in accordance with the present invention.
Figure 4:
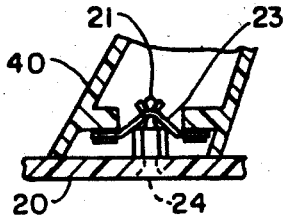
FIG. 4 is a partial sectional view taken along lines 4—4 of FIG. 2 showing the manner in which the handle is affixed to associated plastic sheet.

As may be seen in FIGS. 2, 3 and 4, studs 21 and 22, held in place by screws, engage the stud receiving means in handle 40, particularly in the manner shown in FIG. 4. In operation, the operator places the fabric to be worked upon on a table or similar flat surface. The amount to be utilized is then unrolled or unfolded and a device such as shown in the present invention as 10, 20, or 30 depending on the size of the fabric involved along with a handle 40 is placed upon the fabric to be cut. The fabric then being held firmly with one hand while the other hand performs the necessary marking, cutting or trimming in alignment with the lines on the tool. After which the tool will be lifted up and the fabric either removed or shifted to facilitate furthur operations.

It should be appreciated from the foregoing description the present invention provides a combination holding and measuring device which facilitates the marking and cutting of fabric and similar materials of various sizes.

It will be obvious to those skilled in the art that numerous modifications of the present invention may be made without departing from the spirit of the present invention which shall be limited only by the scope of the claims appended hereto.

What is claimed is:

1. A tool for holding fabric or similar material comprising:

a C-shaped handle;

a plurality of selectively interchangeable rectangular sheets of transparent material and of different sizes each including first and second connecting means for connecting said sheet to said handle;

said handle further including two receiving means to receive said connecting means of each of said transparent sheets;

said first and second connecting means adapted to be engaged by said two receiving means;

a plurality of indicia marked on said transparent sheets;

said handle readily detachable, or in the alternative attachable to each of said plurality of sheets separately.

2. A tool as claimed in claim 1 wherein:

said indicia includes a first plurality of parallel lines.

3. A tool as claimed in claim 2 wherein:

said indicia include a second plurality of parallel lines;

said second plurality of lines at right angles to said first plurality of lines;

said first and second plurality of lines constituting a grid pattern of lines.

4. A tool as claimed in claim 1 wherein:

said indicia include a first plurality of diagonal lines running at a first angle to sides of said sheets.

5. A tool as claimed in claim 4 wherein:

there is further included an additional plurality of lines running at a different angle to sides of said sheets and a different angle than said first plurality of diagonal lines.

6. A tool as claimed in claim 5 wherein:

there is further included indicia indicating the angular degree of said first plurality of diagonal lines and an additional indicia indicating the angle of degree of said additional plurality of diagonal lines.

7. A tool as claimed in claim 1 wherein:

said indicia further include a plurality of measurement markings and included on at least one edge of said transparent sheet.

8. A tool as claimed in claim 1 wherein:

said indicia on said sheets include a plurality of measurement markings on each edge of said sheets.

9. A tool as claimed in claim 1 wherein:

said sheets are made of transparent plastic.

10. A tool as claimed in claim 1 wherein:

said handle is constructed of plastic.

11. A tool as claimed in claim 1 wherein:

said connecting means include in each of said transparent sheets comprises first and second vertical studs secured to said transparent sheet;

and said handle includes first and second stud receiving means adapted to receive said connecting means.

* * * * *